United States Patent [19]

Tsuji et al.

[11] Patent Number: 4,668,585

[45] Date of Patent: May 26, 1987

[54] FE-CR-AL TYPE IMPLANT ALLOY COMPOSITE FOR MEDICAL TREATMENT

[75] Inventors: Eiji Tsuji; Hirobumi Okabe; Hideo Ike; Fumihiro Uratani; Takashi Ota; Hiroshi Kaneda; Yuko Hanatate; Tadashi Hamada; Hironobu Oonishi, all of Osaka, Japan

[73] Assignee: Osaka Prefecture, Horonobu Oonishi and Kyocera Corporation, Osaka, Japan

[21] Appl. No.: 741,464

[22] Filed: Jun. 5, 1985

[30] Foreign Application Priority Data

Jun. 8, 1984 [JP] Japan ..... 59-11889

[51] Int. Cl.[4] ..... B32B 15/04

[52] U.S. Cl. ..... 428/469; 148/6

[58] Field of Search ..... 148/31.5, 6; 75/124 F, 75/124 R; 428/469; 433/201; 604/175, 93

[56] References Cited

U.S. PATENT DOCUMENTS

| | | | |
|---|---|---|---|
| 3,660,173 | 5/1972 | Matsuno et al. | 75/124 |
| 3,754,898 | 8/1973 | McGurty | 75/124 |
| 3,852,063 | 12/1974 | Nimi et al. | 75/124 |
| 4,086,085 | 4/1978 | McGurty | 148/31.5 |
| 4,204,862 | 5/1980 | Kado et al. | 148/31.5 |

*Primary Examiner*—Melvyn J. Andrews
*Assistant Examiner*—Deborah Yee
*Attorney, Agent, or Firm*—Spensley Horn Jubas & Lubitz

[57] ABSTRACT

An Fe-Cr-Al type implant alloy for medical treatment wherein the alloy consists essentially of, by weight, 20–32 % chromium, 0.5–5.0% aluminum, 0.5–4.0% molybdenum, 0.05–0.5% M (wherein M represents at least one kind selected from zirconium and hafnium), and the remainder being substantially iron, wherein the alloy includes an oxide film on the surface, the film being composed substantially of $\alpha$-$Al_2O_3$, and a method of making the alloy implant.

7 Claims, 1 Drawing Figure

FE-CR-AL TYPE IMPLANT ALLOY COMPOSITE FOR MEDICAL TREATMENT

BACKGROUND OF THE INVENTION

1. Field of the Invention

This invention relates to an Fe-Cr-Al type implant alloy for medical treatment. The alloy of the invention is useful as an implant material for medical treatment such as orthopedic surgery and dental surgery.

2. Prior Art

The implant material for orthopedic surgery is required to have the following properties:

1. that the implant material should be free from dissolution and absorption;
2. that the material should be excellent in corrosion resistance;
3. that the material should be excellent in mechanical strength and stable in its property over a long period of time;
4. that the material should be nonpoisonous and nonirritative;
   this is an essential problem that should be grasped not only as a direct and local problem but also as a comprehensive problem; and
5. that the material should have good biocompatibility with the tissue of a living body around the material. Namely, the material should be excellent in adaptability with the tissue or in affinity with the living body. If the implant material is low in biocompatibility with the tissue, a fibrous tissue which blocks and isolates the material from coming into contact with the living body develops in the living body in contact with the implant material with the result that the connection between the material and the living body gets loosened and gives rise to various impediments.

A Fe-Ni-Cr type austenite stainless steel is being used as a conventional implant material. This stainless steel is excellent in mechanical property but offers a problem yet to be solved such as affinity with the living body. In addition, the stainless steel is not always sufficient in stress corrosion cracking resistance, pitting corrosion resistance, crevice corrosion resistance, and other corrosion resisting properties, so that the use of the stainless steel is limited to a short period of time. In addition, the harmful effects on the human body of the dissolved metallic ions, especially nickel ion or the like are a problem.

In recent years, trial use has been made of a ceramic material. This has many advantages in that it is excellent in corrosion resistance, stable in a living body over a long time, nonpoisonous to the body and high in biocompatibility, therewith. But it has the great disadvantage that it is deficient in mechanical strength, especially deflection resistance.

SUMMARY OF THE INVENTION

In view of the circumstances described above, the inventors have made extended research and have finally completed a novel implant alloy having, in combination, the superior mechanical properties of a stainless steel material, excellent biocompatibility of a ceramic material with the human body, and high resistance to corrosion, and have completed a method of making the implant alloy.

That is to say, the alloy according to the invention relates to an Fe-Cr-Al type implant alloy for use in medical treatment, the alloy consisting essentially of 20–32% by weight of chromium, 0.5–5.0% by weight of aluminum, 0.5–4.0% by weight of molybdenum, 0.05–0.5% by weight of M (wherein M represents at least one kind of zirconium and hafnium, the same shall apply hereinafter), and iron which forms the rest of the constituents.

Since the implant alloy of the invention contains aluminum and M in suitable amounts, it forms on the surface an oxide film composed substantially of $\alpha$-$Al_2O_3$ dense and excellent in adherence by heating in the air or oxygen. This oxide film has a property excellent in biocompatibility with a living body and has excellent corrosion resistance. Furthermore, the implant alloy of the invention is not inferior in practical use to AISI 316 L conventionally used as an implant material for a living body nor to Fe-30 Cr-Mo type alloy, which is a basic alloy of the alloy of the invention, and has sufficient strength to be used as an implant material.

DETAILED DESCRIPTION OF THE INVENTION

Figure 1:
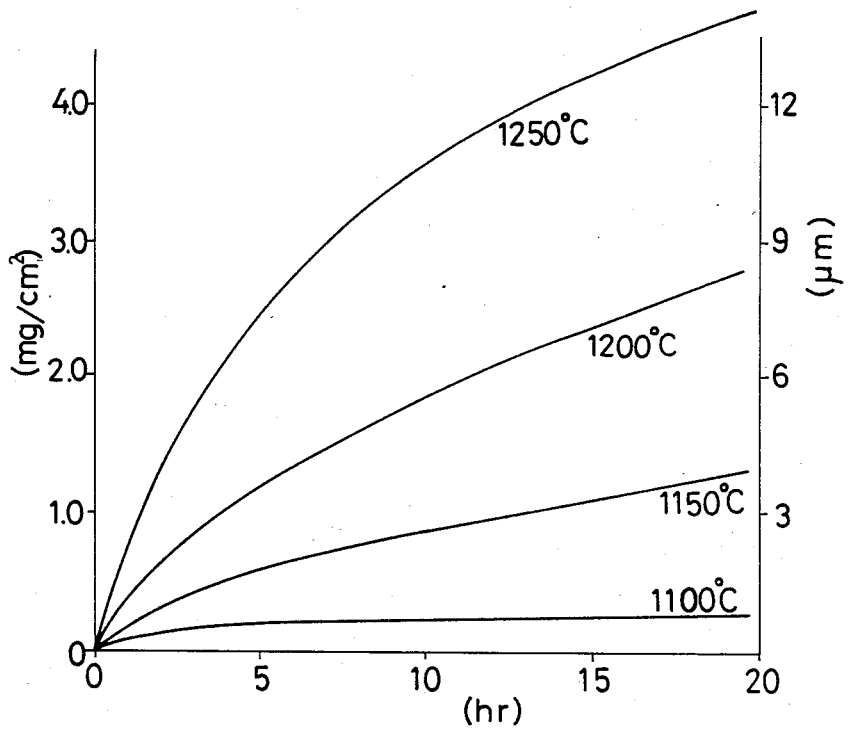
FIG. 1 (the sole FIGURE of the drawing) is a graphic representation of a relation of the mass increased by oxidation and the thickness of oxide film with respect to heat treatment of the alloy of the invention.

A detailed description will be given in the following of the content and function of the elements contained in the implant alloy of the invention.

1. Chromium: 20–32% by weight

Chromium is an indispensable element in improving the corrosion resistance of an iron-based alloy as a constituent for forming a passive film. With an increase in the amount of chromium, corrosion resistance increases. But because the alloy is synergically embrittled in the combined presence of elements such as aluminum, molybdenum, the upper limit of chromium content is 32% by weight of the implant alloy. The alloy of the invention may find its application as an implant in vivo whose use extends over a short period of about two to three months. In this case, a criterion of the alloy requisite for corrosion resistance is moderated in a certain degree, but corrosion resistance higher than that of high purity ferrite type stainless steel of the order of at least 18 chromium is required, so that the lower limit of the chromium content of the alloy is 20% by weight.

2. aluminum: 0.5–5.0% by weight

Aluminum is an important element in forming an oxide film in the invention, but for improvement in the corrosion resistance of the alloy of the invention, it is necessary to add at least 1.5%, preferably about 3% by weight of molybdenum. And for this addition of molybdenum the content of aluminum is controlled to a maximum of 5.0% by weight.

On the other hand, when the aluminum content is small, $\alpha$-$Al_2O_3$ produced by heat treatment is decreased and the amount of $Cr_2O_3$ produced is increased. If the proportion of $Cr_2O_3$ is increased, boundary between two kinds of oxide is increased, with the result that the brittleness of oxide film on the surface of the alloy deteriorates to reduce the function of the alloy material. Accordingly, when heat treatment is performed in atmosphere or oxygen, a content of more than about 2% inclusive by weight of aluminum is preferred. Also, when heat treatment of the material is performed by regulating the atmosphere to a pressure lower than atmospheric pressure, it is possible to get the lower limit of aluminum content at 0.5% by weight. When the upper limit of aluminum content exceeds 5%, the alloy deteriorates in toughness and workability.

3. Molybdenum: 0.5–4.0% by weight

Molybdenum has a marked effect in the improvement of corrosion resistance, especially pitting corrosion resistance, and crevice corrosion resistance, and an amount of more than 0.5% inclusive by weight of molybdenum is necessary for achieving this effect. On the other hand, an increase in the amount of molybdenum tends to lower the toughness and, in addition, promotes deterioration particularly in workability in the combined presence of chromium and aluminum. For this reason, the upper limit of molybdenum content is set at 4.0% by weight.

4. M (wherein M represents one kind of zirconium and hafnium): 0.05–0.5% by weight M, in the implant material of the invention, infiltrates into the oxide film composed substantially of $\alpha$-$Al_2O_3$, and imparts high toughness to the oxide film which is originally very brittle, and is somewhat higher in affinity with oxygen than aluminum, and accordingly the film is internally oxidized to form fine oxide particles and thus improves adherence of the surface oxidized film to the alloy matrix. But when the amount of M content is increased, the degree of M mixed into the film is increased not only to make the film deteriorate in density but also to produce adverse effects on the corrosion resistance of the alloy matrix, cold and hot workability, and toughness of the alloy. Accordingly, the upper limit of M content is 0.5% by weight. On the other hand, when the M content is too small, the alloy obtained cannot bring the toughness of the film, adherence thereof into full swing, so that the lower limit of M content is set at 0.05% by weight.

5. Others

Silicon causes embrittlement of alloy and, when heat treatment is performed silicon is oxidized into $SiO_2$ to be incorporated in $\alpha$-$Al_2O_3$ film, with the result that it is desirable to reduce silicon content to less than 0.3% inclusive by weight. Carbon and nitrogen make a ready reaction with chromium in heat treatment to form a chromic compound. This chromic compound has the strong tendency of being formed in the grain boundary of the alloy, and brings about reduction of chromium density in the neighborhood of the boundary and induces corrosion of grain boundary. Furthermore, carbon has also the action of becoming carbon oxide and carbon dioxide gases to break the $\alpha$-$Al_2O_3$ film. From the fact described above, it is desirable to set the carbon content of the alloy at less than 0.008% inclusive by weight and nitrogen content at less than 0.015% inclusive by weight. Because phosphorous and sulphur also impair the toughness of steel, it is desirable to set those at less than 0.025% inclusive by weight respectively.

6. The remainder being substantially iron

The alloy in the above range of compositions maintains a ferrite structure even by heating (1,100°–1,300° C.) that will later be described.

The method of making the implant alloy of the invention is not placed under particular restriction but renders it possible to manufacture the alloy in the range of compositions described above by conventional methods, namely by vacuum melting and as the case may be, by melting in a nonoxiding atmosphere.

The alloy of the invention, after subjected to heat treatment, is used as an implant material. This heat treatment provides an oxide film, the film being composed substantially of $\alpha$-$Al_2O_3$ dense in structure and excellent in adherence to an alloy matrix. The heat treatment is carried out in the air or oxygen normally at atmospheric pressure at a temperature of 1,100° to 1,300° C. But when the Al content of the alloy is of the order of 0.5–2% by weight, it is desirable to carry out heat treatment at a pressure lower than atmospheric pressure.

It is only necessary to make suitable selection of heat treatment in a period of time of about 0.5 to 30 hours in accordance with the required thickness of the oxide film. By the way, the composition of the oxide film is for example 90 mol % of $\alpha$-$Al_2O_3$, 5 mol % of $ZrO_2$, 3 mol % of $Fe_2O_3$ and 2 mol % of $Cr_2O_3$.

The implant alloy of the invention is excellent in biocompatibility with the living body and high in corrosion resistance because of the oxide film produced by heat treatment. Furthermore, the alloy matrix itself also shows superior corrosion resistance. The implant alloy of the invention is sufficient also in mechanical property for practical use as an implant material. Accordingly, the alloy of the invention satisfies requisites for the implant material and can be used effectively.

The implant alloy of the invention will now be described with reference to embodiments thereof in the following.

EXAMPLE 1

The Fe-Cr-Al type implant alloy of composition shown in Table 1 was produced by vacuum melting.

TABLE 1

| | Elements | | | | | | | | |
|---|---|---|---|---|---|---|---|---|---|
| | Cr | Al | Mo | Zr | Si | C | N | O | Fe |
| % by weight | 30 | 3.2 | 2.0 | 0.2 | 0.15 | 0.004 | 0.007 | 0.001 | Bal. |

The alloy was heat treated in oxygen to form an oxide film. The accompanying diagram shows the relation of the mass increased by oxidation and the thickness of film produced with respect to heat treatment. A study of sectional structure of the oxide film showed that the boundary between the alloy matrix and surface oxide film run complicatedly into the matrix and the layer to provide excellent adherence. In the heat treatment in the air, the same result was obtained.

i. Mechanical property

Table 2 shows the mechanical properties which the alloy of the invention has before heat treatment. For comparison, the mechanical properties of AISI 316 L used conventionally as an implant material in vivo is also shown in the table. Tensile strength and elongation were tested in accordance with JIS-Z-2201 and hardness was tested in accordance with JIS-Z-2244.

TABLE 2

| | Example 1 | AISI 316 L |
|---|---|---|
| Density (g/cm$^2$) | 7.3 | 8.0 |
| Magnetic property | ferromagnetic | Nonmagnetic |
| Tensile strength (Kg/cm$^2$) | 65 | 63 |
| Hardness (HV) | 250 | 170 |
| Elongation (%) | 15 | 49 |

It emerges from the result shown in Table 2 that the alloy of the invention has the same order of mechanical strength as conventional products.

Shown in Table 3 is change in mechanical properties of the alloy of the invention when heat treated at a temperature of 1,250° C. in the air.

TABLE 3

| Heating time (hr) | Tensile strength ($kg/cm^2$) | Hardness (HV) | Elongation (%) |
|---|---|---|---|
| 1 | 60 | 230 | 15 |
| 3 | 58 | 220 | 10 |
| 5 | 55 | 220 | 10 |
| 20 | 51 | 210 | 10 |

From the result shown in Table 3, it emerges that prolongation of heating time makes little change in mechanical property of the alloy and provides no interference in practical use.

ii. Corrosion resistance test

It is apparent from experiment that the alloy has good corrosion resistance in the state of the alloy being coated with oxide film by heat treatment. Namely, there was no corrosion or wear observed at all by a corrosion resistance test on the items shown in Tables 4 and 5 to be later shown.

Suppose here the case wherein the oxide film of the alloy of the invention is damaged by mechanical impulse or screw fastening and the alloy matrix is exposed into the corrosion environment of living body. A study was made of the corrosion of the alloy matrix. First, a test (of the crevice corrosion resistance) was conducted on the alloy in Example 1 before heat treatment. Namely, a flat test piece was immersed in an aqueous solution of 10% $FeCl_3$ with a glass rod 5 mm in diameter placed on the test piece, and the corrosion of the test piece under the glass rod was observed after 24 hours. The result is shown in Table 4.

TABLE 4

| | Liquid temperature (°C.) | | | |
|---|---|---|---|---|
| | 20 | 40 | 50 | 60 |
| Example 1 | 0 | 0 | Δ | x |
| AISI 316 L | Δ | x | x | x |

0: No crevice corrosion was observed.
x: Heavy crevice corrosion occurred.
Δ: Traces of crevice corrosion were observed.

Shown in Table 5 is the result of the test conducted on alkali resistance, grain boundary corrosion resistance, acid resistance, and stress corrosion resistance. The test was conducted in accordance with JIS-G-0573.

TABLE 5

| | Example 1 | AISI 316 L |
|---|---|---|
| Alkali resistance(1) | 0.05 $g/m^2$ hr | 3.39 $g/m^2 \cdot$ hr |
| Grain boundary(2) corrosion resistance | 0.36 $g/m^2$ hr | 0.24 $g/m^2$ hr |
| Acid resistance(3) | 0.005 $g/m^2$ hr | 18.0 $g/m^2$ hr |
| Stress corrosion(4) crack resistance | over 100 hrs | below 10 hrs |

(1)The amount of weight loss after immersion of the test piece in a boiling aqueous solution of 50% NaOH + 6% NaCl for 48 hours.
(2)The amount of weight loss after immersion of the test piece in a boiling aqueous solution of 65% $HNO_2$ for 48 hours.
(3)The amount of weight loss after immersion of the test piece in a boiling aqueous solution of 1% HCl for 48 hours.
(4)A period of time required for the initiation of stress corrosion cracking after the immersion of a U-bend sample into a boiling aqueous solution of 48% $MgCl_2$.

Furthermore, a test was conducted on the elution of the test piece into a physiological saline solution (3% NaCl) to find that the elution of each of Fe, Cr and Al was less than 1 ppm/200 $cm^2$/liter for 12 days at 20° C. and that when the test piece was immersed in a boiling liquid for 5 hours, Fe was 2 ppm and the others were less than 1 ppm.

From the result above, it is apparent that the invention alloy was superior in corrosion resistance to conventional alloys even when it was placed in the state of being kept from forming an oxide film by heat treatment.

It was also found that the corrosion resistance of the alloy matrix after heat treatment is as much the same as before heat treatment. For example, after the alloy in Example 1 was heated at 1,250° C. for 5 hours in the open air, the oxide film was completely removed by grinding and then tests were conducted on the items in Tables 4 and 5. No difference was noticed between the results obtained and those shown in Tables 4 and 5.

EXAMPLE 2

The same test as that in Table 1 of Example 1 was conducted on the alloy in which zirconium was replaced with hafnium.

The mass increased by oxidation when heat treatment of the alloy in Example 2 was performed was smaller than that in Example 1. For example, when the alloy was heated at 1,200° C. for 20 hours, the mass increased by oxidation was about 1 $mg/cm^2$. The adherence of this oxide film was excellent in the same degree as that in Example 1.

A test was further conducted on the mechanical property and corrosion resistance of the alloy in the same manner as that in Example 1, to obtain as much the same results from Hf contained alloy as the result in Example 1. (Animal experiment result)

Experiment plates each having a size 20 mm long, 7 mm wide and 1 mm thick were prepared from the alloy of the invention and an alloy of contrast example AISI 316 L. Th plates were transplanted into the shinbone surface of full-grown rabbits. The results shows that, in the oxide formed alloy of the invention, a connective tissue membrane intervening between the plate and the bone becomes thinner with the lapse of time such that it becomes hard to notice by the optical microscope standard in four to six weeks. Also, development of an osteoid substance is noticed around the transplanted plate with surface oxide. To the surface of the plate are fixed cartilage and osteoid tissue, and the amount of tissue fixed also increases and becomes dense in proportion to the length of transplantation time. The amount of the tissue fixed to the surface of AISI 316 L is less than that of bare surface of the invention alloy. The alloy of the invention after heat treatment is entirely free from detrimental dissolution of metallic ions in a living body and yet offers no problem from the viewpoint of strength of materials.

We claim:

1. A composite article comprising an alloy having a surface and a film on the surface, said alloy consisting essentially of, by weight:

20–32% chromium
0.5–5.0% aluminum,
0.5–4.0% molybdenum,
0.05–0.5% M where M is selected from the group consisting of zirconium, hafnium and mixtures thereof;
and the remainder being iron, wherein said film is composed substantially of $\alpha$-$Al_2O_3$.

2. A composite article comprising an alloy having a surface and a film on the surface, said alloy consisting essentially of, by weight:

20–32% chromium,
0.5–5.0% aluminum,
0.5–4.0% molybdenum,
0.05–0.5% M where M is selected from the group consisting of zirconium, hafnium and mixtures thereof;
0.3% silicon,
0.008% carbon,
0.015% nitrogen,
and the remainder being iron, wherein said film is composed substantially of $\alpha$-$Al_2O_3$.

3. A composite article according to claim 2 wherein said alloy consists essentially of, by weight:

0.025% phosphorous, and
0.025% sulphur.

4. A composite article consisting essentially of a major constituent having a surface and a film on the surface, the major constituent consisting of, by weight:

20–32% chromium;
0.5–5.0% aluminum;
0.5–4.0% molybdenum;
0.05–0.5% M where M is selected from the group consisting of zirconium, hafnium and mixtures thereof;
less than 0.3% silicon,
less than or equal to 0.008% carbon,
less than or equal to 0.015% nitrogen,
less than or equal to 0.025% phosphorous;
less than or equal to 0.025% sulfur;
and the remainder being iron, wherein film is composed substantially of alpha aluminum oxide.

5. A composite article consisting essentially of a major constituent having a surface and a film on the surface, the major constituent consisting of, by weight:

20–32% chromium;
0.5–5.0% aluminum;
0.5–4.0% molybdenum;
0.05–0.5% M (where M is selected from the group consisting of zirconium, hafnium and mixtures thereof);
less than 0.3% silicon;
less than or equal to 0.008% carbon;
less than or equal to 0.015% nitrogen;
less than or equal to 0.025% phosphorous;
less than or equal to 0.025% sulfur;
and the remainder being iron, wherein film consists of 90 mol percent of alpha aluminum oxide, 5 mol percent of zirconium oxide, 3 mol percent of iron oxide and 2 mol percent of chromium oxide.

6. A composite article according to claim 5 wherein the major constituent consists essentially of 30% chromium, 3.2% aluminum, 2.0% molybdenum, 0.2% zirconium, 0.5% silicon, 0.004% carbon, 0.007% nitrogen, less than or equal to 0.025% phosphorous, less than or equal to 0.025% sulfur and the remainder being iron.

7. A composite article according to claim 5 wherein the major constituent consists essentially of 30% chromium, 3.2% aluminum, 2.0% molybdenum, 0.2% hafnium, 0.5% silicon, 0.004% carbon, 0.007% nitrogen, less than or equal to 0.025% phosphorous, less than or equal to 0.025% sulfur and the remainder being iron.

* * * * *